US007900538B2

(12) United States Patent
Phillips et al.

(10) Patent No.: US 7,900,538 B2
(45) Date of Patent: Mar. 8, 2011

(54) PACKABLE BATTERING RAM

(75) Inventors: Darron Phillips, San Antonio, TX (US); Jeff Wright, Bulverde, TX (US); Jeff Lambert, Houston, TX (US)

(73) Assignee: Breaching Technologies, Inc., San Antonio, TX (US)

( * ) Notice: Subject to any disclaimer, the term of this patent is extended or adjusted under 35 U.S.C. 154(b) by 224 days.

(21) Appl. No.: 12/251,053

(22) Filed: Oct. 14, 2008

(65) Prior Publication Data

US 2010/0089205 A1 Apr. 15, 2010

(51) Int. Cl.
*B25D 1/00* (2006.01)

(52) U.S. Cl. ..... 81/20; 173/126; 7/146; 7/166; D8/81

(58) Field of Classification Search ..... 81/20, 289; 173/90, 126; 29/254, 270, 275; 7/143, 146, 7/147, 166; 16/110.1; D8/75, 80, 81
See application file for complete search history.

(56) References Cited

U.S. PATENT DOCUMENTS

| | | | | |
|---|---|---|---|---|
| 4,658,975 | A * | 4/1987 | Cone | 215/385 |
| 4,681,171 | A * | 7/1987 | Kee et al. | 173/90 |
| 5,177,850 | A * | 1/1993 | Hull et al. | 29/254 |
| 5,706,553 | A * | 1/1998 | Riley et al. | 16/111.1 |
| 5,716,305 | A * | 2/1998 | Selsam | 482/93 |
| 6,536,308 | B1 * | 3/2003 | Thorne et al. | 81/20 |
| 6,730,004 | B2 * | 5/2004 | Selsam | 482/93 |
| 6,981,933 | B2 * | 1/2006 | Scafidel | 482/110 |
| 7,244,220 | B2 * | 7/2007 | Carney | 482/106 |

* cited by examiner

*Primary Examiner* — D. S Meislin

(57) ABSTRACT

A packable battering ram quickly disassembled for transport by two or more persons. In the preferred embodiment, the invention has first and second body members that are symmetrical, but otherwise identically shaped and sized. When assembled, the first and second body members form a lower surface that has a concave portion that approximates the natural curvature of the back of an adult male. The packable battering may be disassembled to distribute the weight between multiple people, yet quickly assembled for use upon arrival at a emergency response location.

11 Claims, 5 Drawing Sheets

PACKABLE BATTERING RAM

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to devices for effecting forced entry. More specifically, the present invention is a packable battering ram that is quickly and easily disassembled into its constituent parts for transport by one or more persons.

2. Description of the Related Art

Battering rams have been used throughout the ages for penetrating fortified positions. Battering rams are commonly used today by the military, law enforcement, firefighters, emergency response workers, and other public safety personnel to effect forced entry into a building or structure. Typical battering rams, however, are limited by their design to function solely to breach a door or other barricade, and are without the ability to act as a cutting, chopping, or prying devices upon the door or barricade.

U.S. Pat. No. 4,681,171 (the '171 patent), for example, discloses a typical battering ram that includes a bulky, concrete-filled cylinder with an epoxy resin head. The battering ram disclosed in '171 patent, however, is physically difficult to pack due to both its bulky design and its weight.

A typical soldier will lose one mile per day for every ten pounds over forty he must carry, so the inability of traditional cumbersome battering rams to be comfortably carried or packed has often lead soldiers, law enforcement officers, and other such public safety personnel to jettison the devices if the likelihood of use is low. Should such a device later be needed, the soldier must instead implement improvised methods of entry, such as shooting through the door or using explosives. Such improvised methods are dangerous for the user, and also increase the possibility of collateral damage to whomever or whatever is on the other side of the door.

Thus, a need exists for a comfortable, multi-use, packable battering ram with an ergonomic design and weight optimization to ease the burden of transport during lengthy operations.

Such a battering ram is at least thirty pounds in weight but can be disassembled into constituent parts so that no person is tasked with carrying more than twenty pounds.

BRIEF SUMMARY OF THE INVENTION

The present invention provides a single multipurpose tool capable of ramming, hammering. Besides the ability to perform multiple tasks with a single tool, the present invention also applies anthropometrics to create an ergonomic form that enables to the tool to be easily packed and deployed with minimal hindrance to movement or function.

The battering ram of the present invention generally conforms to the shape of the back of an average person, making transportation comfortable. The battering ram is easily disassembled into two corresponding body members, thereby allowing each member to be carried by a separate person, thus reducing the weight burden on each person. According to the preferred embodiment, the battering ram has a ramming head which extends perpendicularly outward on one side and terminates in a prying member. The sharp edge gives the battering ram the ability to be used to chop or pry a target.

DETAILED DESCRIPTION OF THE INVENTION

Figure 1:
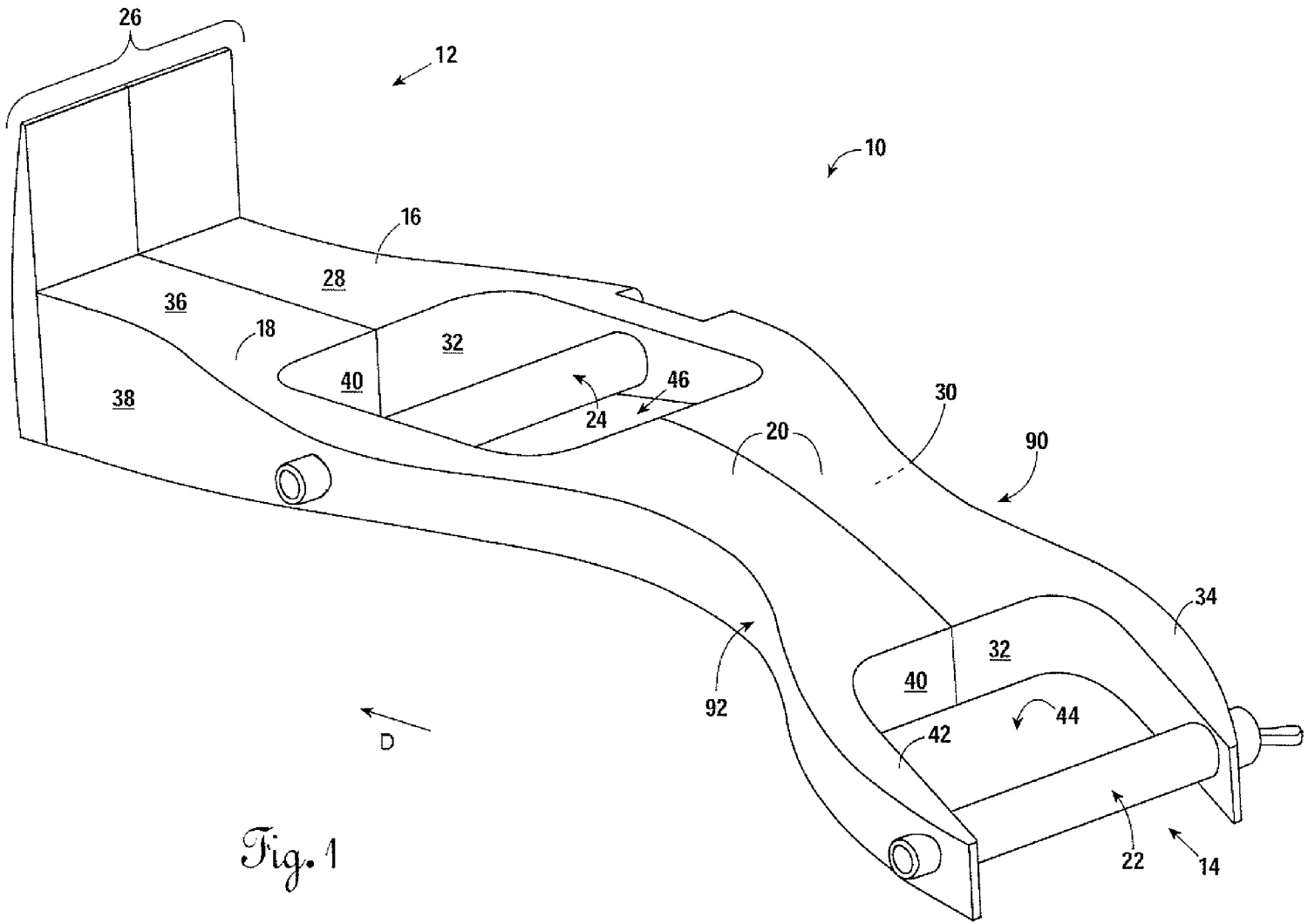
FIG. 1 is a perspective view of the assembled battering ram of the present invention.

FIG. 1 is a perspective view of the preferred embodiment of a packable battering ram 10 that incorporates the limitations of the present invention. The battering ram 10 has a ramming end 12 and a handle end 14, and further includes a first body member 16 and a second body member 18 that is substantially symmetrical in shape to the first body member 16. The first and second body members 16, 18, which together compose the main body 20, are connected with a first handle assembly 22 at the handle end 14 and a second handle assembly 24 positioned between the ramming end 12 and the first handle assembly 22. A ramming head 26 is attached to the first and second body members 16, 18 at the ramming end 12.

The first body member 16 has a top surface 28, an outer sidewall 30, and an inner sidewall 32. A first side member 34 is integrally formed into the first body member 16 to expose the inner sidewall 32 proximal to the handle end 14. Similarly, the second body member 18 has a top surface 36, an outer sidewall 38, an inner sidewall 40, and a second side member 42 is integrally formed into the second body member 18 to expose the inner sidewall 40 proximal to the handle end 14. First and second contoured portions 90, 92 of the sidewalls 30, 38 narrow the first and second body members 16, 18, respectively near proximal to the first hand hole 44.

When assembled, the first and second side members 34, 42 define a first hand hole 44 bounded on three sides by the inner sidewalls 32, 40. The connection of the first body member 16 to the second body member 18 forms a second hand hole 46 across which the second handle assembly 24 spans.

The thickness of the first and second body members 16, 18, and therefore the corresponding widths of the outer sidewalls 30, 38, is greater proximal to the ramming end 12 as compared to the handle end 14. Thus, the first and second body members 16, 18 are bulkier and heavier proximal to the ramming end 12 as opposed to the handle end 14, such that the center of mass of the battering ram 10 is preferably located between the ramming head 26 and the second handle assembly 46 (inclusive). The location of the center of mass allows the battering ram 10 to transfer more kinetic energy on a target in direction D during use.

Figure 2:
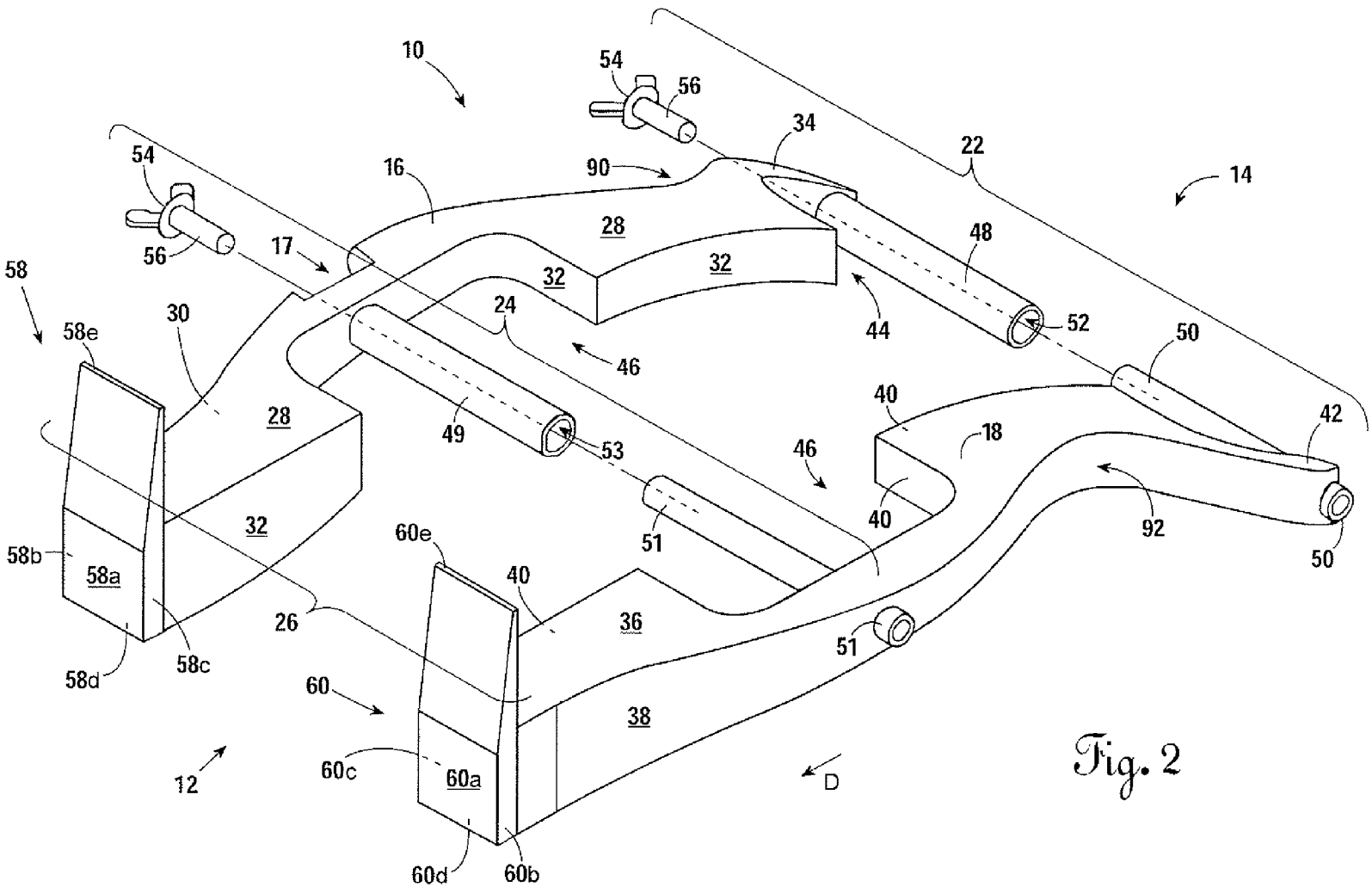
FIG. 2 is a partially exploded perspective view of the battering ram of the present invention showing the first body member and second body member.

FIG. 2 is a reverse isometric assembly view of the battering ram 10 described in FIG. 1. The first handle assembly 22 comprises a cylindrical external handle member 48 and a cylindrical internal handle member 50 sized to fit therein. Similarly, the second handle assembly 24 comprises a cylindrical external handle member 49 and a cylindrical internal handle member 51 sized to fit therein. The external handle members 48, 49 are connected (either permanently or temporarily with conventional fastening techniques) to the first body member 16 at the inner sidewall 32 thereof. Similarly, the internal handle members 50, 51 are connected (either permanently or temporarily with conventional fastening techniques) to the inner sidewall 40 thereof.

Each external handle member 48, 49 has a bore 52, 53 disposed therethrough for receiving the corresponding internal handle member 50, 51. In addition, each internal handle member 50, 51 is internally threaded (not shown) to allow fastening with a wing bolt 54 having a threaded shaft portion 56.

The ramming head 26 comprises a first ramming member 58 attached to the ramming end 12 of the first body member 16. The first ramming member 58 has an outer ramming surface 58*a*, a lateral surface 58*b* that is substantially flush with outer sidewall 30, and a medial surface 58*c* that is substantially flush with inner sidewall 32. The first ramming member 58 extends perpendicularly away from the top surface 28 of first body member 16, and terminates in a tapered prying member 58*e*.

Similarly, the ramming head 26 comprises a second ramming member 60 attached to the ramming end 12 of the second body member 18. The second ramming member 60 has an outer ramming surface 60*a*, a lateral surface 60*b* that is substantially flush with the outer sidewall 38, and a medial surface 60*c* that is substantially flush with inner sidewall 40. The second ramming member 60 extends perpendicularly away from the top surface 36 of the second body member 18, and terminates in a tapered prying member 60*e*. In the preferred embodiment, the first and second ramming members 58, 60 are symmetrical, but otherwise identically shaped and sized.

To assemble the battering ram 10, the first body member 12 and second body member 14 are aligned such that the first ramming member 58 and second ramming member 60 are adjacent each other, with one prying member 58*e* adjacent to the other prying member 60*e*. The internal handle member 50 of the first handle assembly 22 is inserted into the bore 52 of its corresponding external handle member 48. Similarly, the internal handle member 51 of the second handle assembly 24 is inserted into the bore 53 of its corresponding external handle member 49. The threaded shafts 56 of two wing bolts 54 are disposed through the first body member 16 at a recessed portion 17 thereof and the first side member 34, and are mated with the internal handle members 50, 51. When fully tightened, the wing bolts 54 clamp the first and second body members 16, 18 together such that the inner sidewalls 32, 40 are in contact and form the first and second hand holes 44, 46.

Figure 3:
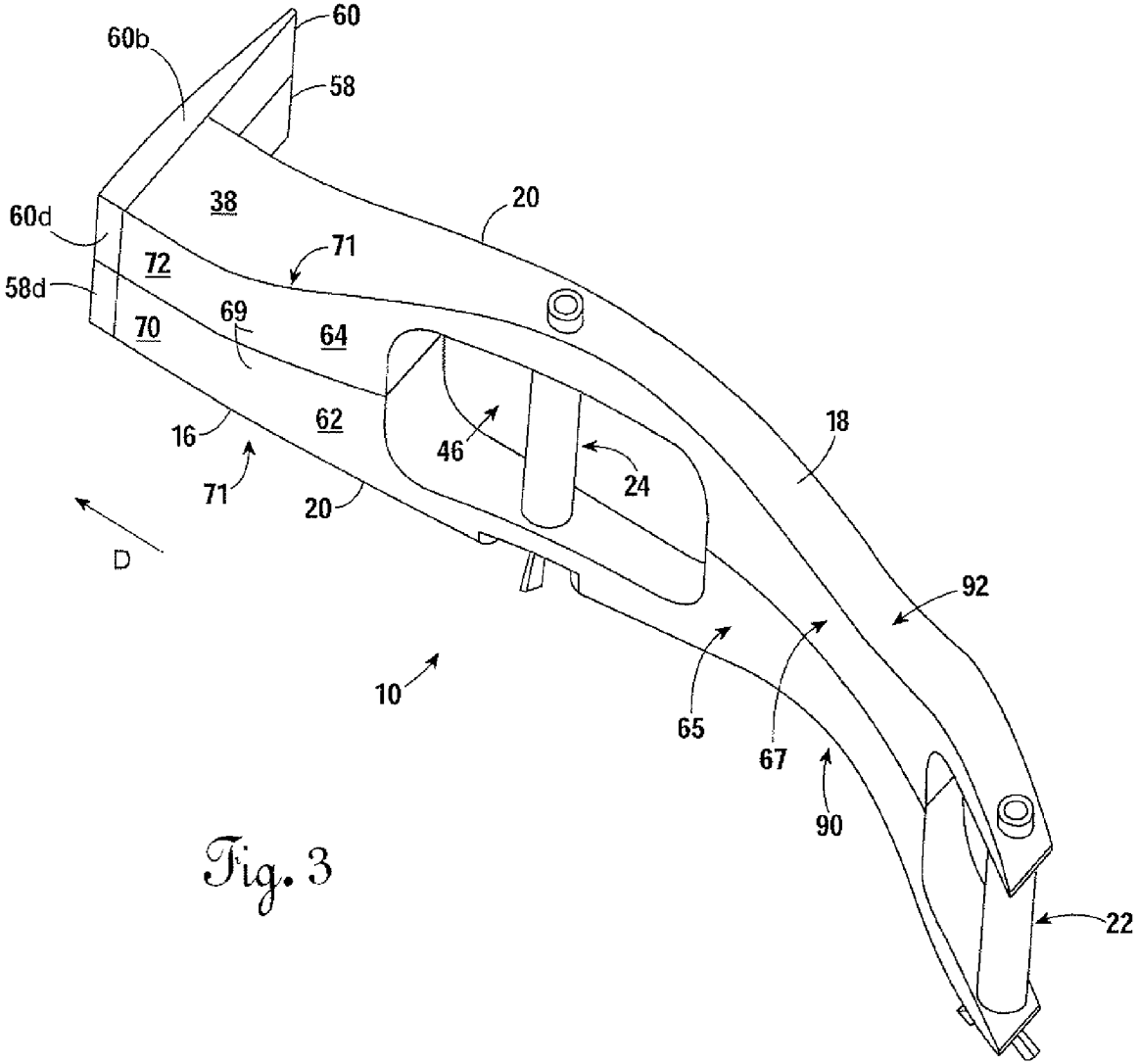
FIG. 3 is a bottom perspective view of the assembled battering ram of the present invention.

FIG. 3 is a bottom isometric view of the assembled battering ram 10 of the present invention. A bottom surface 58*d* of the first ramming member 58 is substantially flush with a first surface 62 of first body member 16. Similarly, a bottom surface 60*d* of the second ramming member 60 is substantially flush with a second surface 64 of the second body member 14.

As further shown in FIG. 3, the first surface 62 and second surface 64 each comprise a concave portion 65, 67, and together form a lower surface 69 of the body 20. The lower surface 69 also comprises a convex portion 71 adjacent the concave portions 65, 67 and planar first and second strike faces 70, 72 for receiving a substantially perpendicular blow from a blunt object, such as a hammer. This allows the prying members 58*e*, 60*e* to penetrate further into a target in anticipation of prying the target apart from a supporting structure. In the preferred embodiment, the concave portions 65, 67 of the lower surface 69 approximate the normal curvature of a human adult back.

Figure 4:
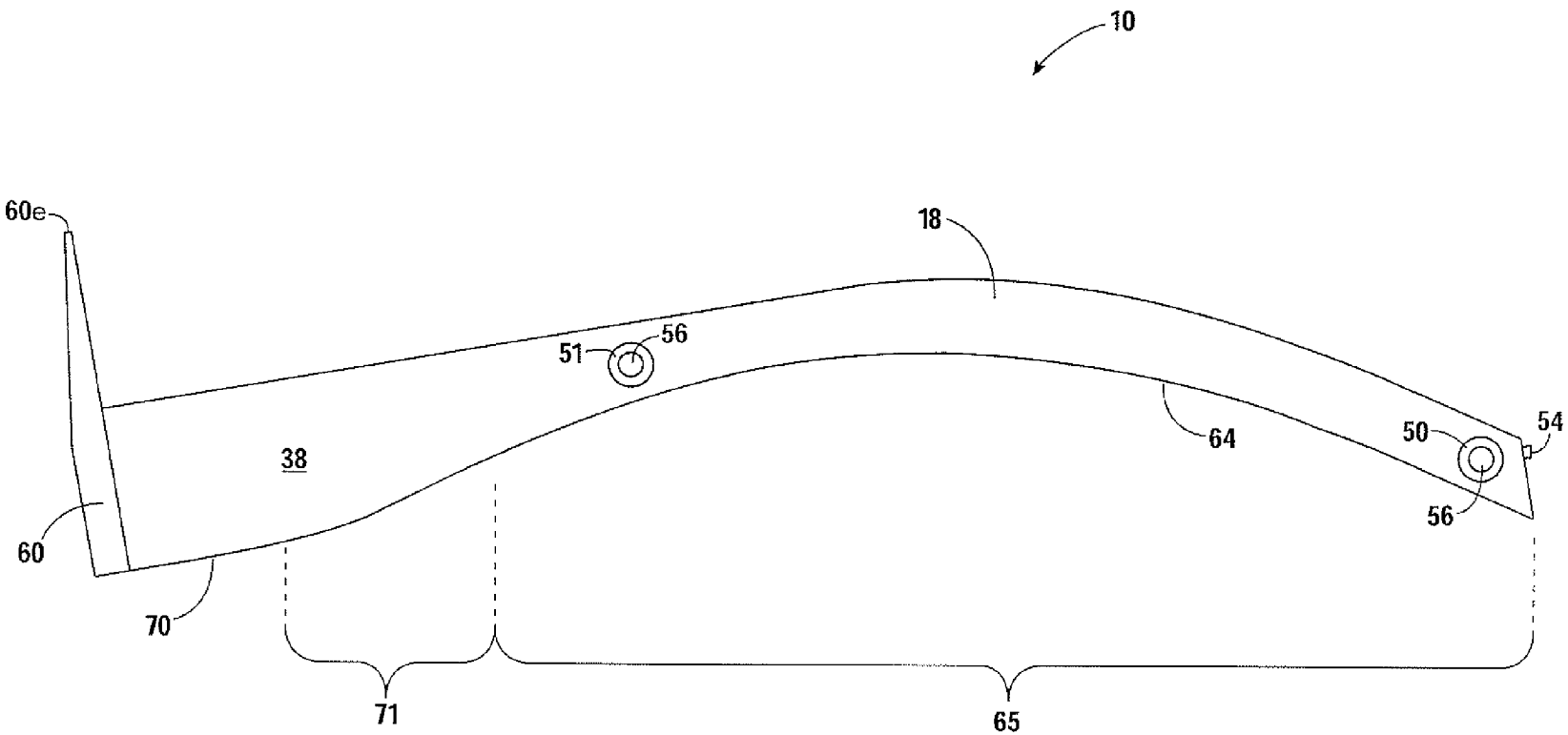
FIG. 4 is a side elevation of the second body member of the preferred embodiment.

FIG. 4 shows the curvature of the battering ram 10 in greater detail by depicting a side elevation of the second body member 18. As noted with respect to FIG. 3, the battering ram 10 has a second surface 64 having a concave portion 65. The convex portion 71 is immediately adjacent the concave portion 65 and the strike face 70. Together the concave portion 65 and convex portion 70 approximate the normal curvature of a human adult back.

Figure 5:
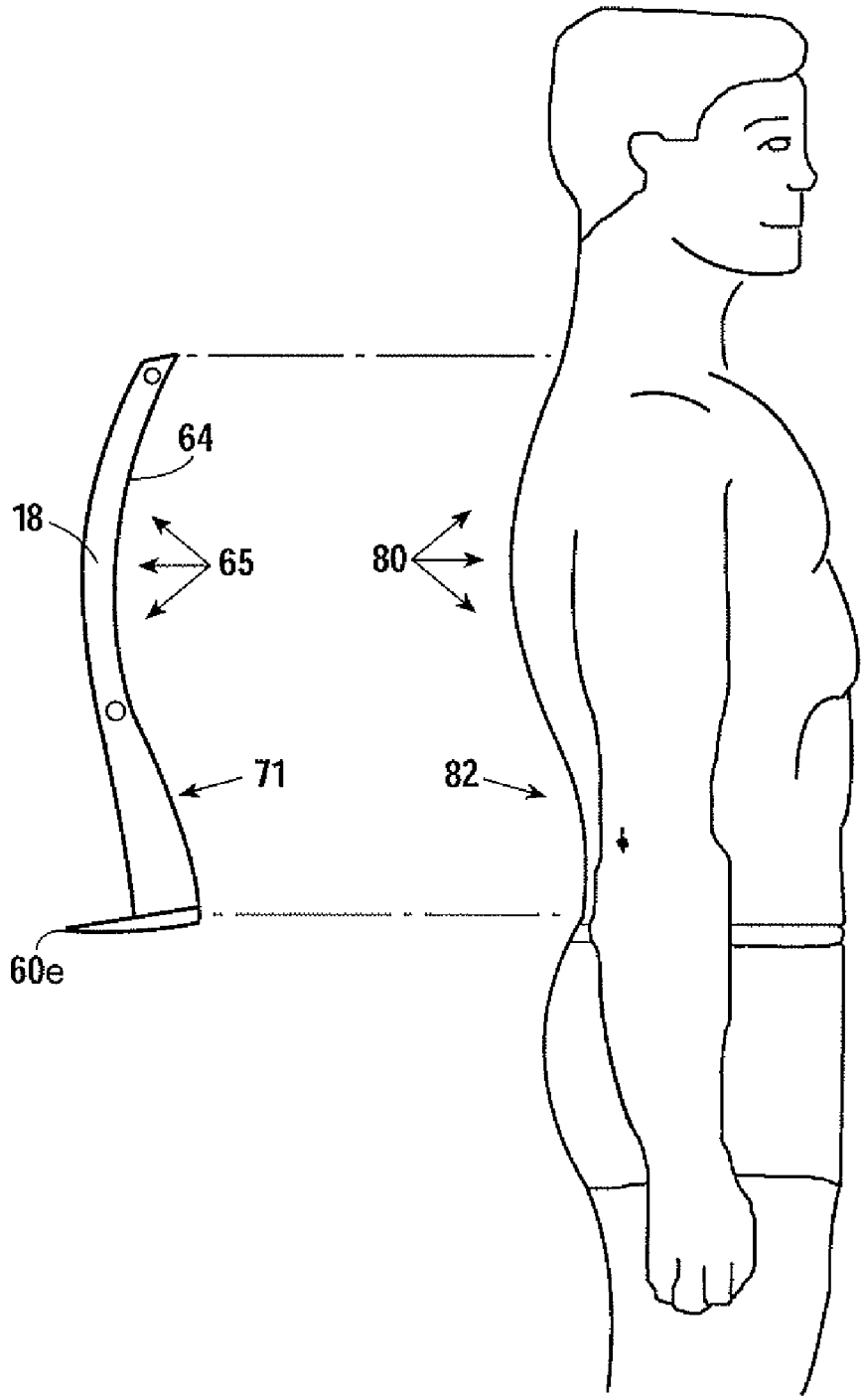
FIG. 5 is a side elevation of the battering ram of the present invention when transported by a person an adult male.

FIG. 5 depicts the battering ram 10 as packed by an adult male. While FIG. 5 specifically describes transport of the second body member 18, it should be noted that transport of the first body member 16 (not shown) is analogous with respect to the preferred embodiment because of its symmetrical size and shape. Because the battering ram 10 can be quickly dissembled, its weight can be distributed approximately equally between two persons, with one carrying the second body portion 18 and attached components and another carrying the first body portion 16 and attached components. At the location to be forcibly entered, the battering ram 10 can be quickly reassembled and used with the full mass of the battering ram 10 again available. It is anticipated, however, that the component parts could be used separately and distinctly as hammering, prying, or ramming tools should the need arise.

As shown in FIG. 5, the concave portion 65 fits to the convex curvature 80 of the back, while the convex portion 71 of the second surface 64 fits to the concave portion 82 of the back (i.e., the "small" of the back). The prying member 60*e* protrudes away from the person during transport. The battering ram 10 can be secured to the person by straps such that the straps rest on each shoulder of the person. Alternatively, any other suitable attaching device may be employed to comfortably attach the second body member 18 to a person.

Referring again to FIG. 2 and FIG. 3, the battering ram 10 is most effectively used to ram a target (not shown) with the hands of a person placed with the palms facing each other as the first handle assembly 22 and second handle assembly 24 are gripped. Ramming surfaces 58*a* and 60*a* of first ramming member 58 and second ramming member 60, respectively, are substantially parallel to the target. In operation, the battering ram 10 is swung in a substantial arc or pendulum backwards, and then in direction D to strike the target and transfer the kinetic energy from the battering ram 10 to the target. To chop a target, the battering ram 10 is turned such that prying members 58*e*, 60*e* are turned toward the target (not shown). First and second contoured portions 90, 92 provide gripping locations to allow a person to grip and swing the battering ram toward the target. The first and second contoured portions 90, 92 also provide gripping surfaces to allow a person to pull on the battering ram 10 to pry a target (not shown).

The present invention is described above in terms of a preferred illustrative embodiment of a specifically described packable battering ram. Those skilled in the art will recognize that alternative constructions of such an apparatus can be used in carrying out the present invention. Other aspects, features, and advantages of the present invention may be obtained from a study of this disclosure and the drawings, along with the appended claims.

We claim:

1. A packable battering ram having a ramming end and a handle end, said packable battering ram comprising:

a first body member having a first surface at least a first portion of which is concave;

a second body member having a second surface at least a first portion of which is concave;

a ramming head attached to said first and second body members;

a first handle assembly connecting said first body member to said second body member at said handle end; and a second handle assembly connecting said first body member to said second body member at a position between said ramming head and said first handle.

2. The packable battering ram of claim 1 wherein said second body member is substantially symmetrical to said first body member.

3. The packable battering ram of claim 1 wherein said ramming head comprises a first ramming head member connected to said first body member and a second ramming head member connected to said second body member.

4. The packable battering ram of claim 1 wherein said ramming head comprises at least one of a strike face, a ramming surface, and a prying member.

5. The packable battering ram of claim 1 wherein at least a portion of said first surface is convex.

6. The packable battering ram of claim 1 wherein at least a portion of said second surface is convex.

7. The packable battering ram of claim 1 wherein said first surface and said second surface are shaped and orientated to approximate the normal curvature of a human adult back.

8. The packable battering ram of claim 1 wherein each of said first handle assembly and said second handle assembly comprise an exterior handle member connected to one of said first body member and said second body member, and an interior handle member connected to the other of said first body member and said second body member, wherein said interior handle member is positionable within said exterior handle member and fastenable thereto.

9. The packable battering ram of claim 1 wherein said first body member and said second body member can be quickly disassembled for packing by at least two persons.

10. The packable battering ram of claim 1 having a center of mass positioned between said ramming end and said second handle assembly.

11. The packable battering ram of claim 1 further comprising at least one carrying strap connected to one of said first handle assembly, said second handle assembly, said first body member, and said second body member.

* * * * *